US007055708B1

(12) United States Patent
Haffner et al.

(10) Patent No.: US 7,055,708 B1
(45) Date of Patent: Jun. 6, 2006

(54) CHILD-RESISTANT PACKAGE

(75) Inventors: Eugene F. Haffner, Waterville, OH (US); Noel T. Vander, Perrysburg, OH (US)

(73) Assignee: Owens-Illinois Prescription Products Inc., Toledo, OH (US)

( * ) Notice: Subject to any disclaimer, the term of this patent is extended or adjusted under 35 U.S.C. 154(b) by 168 days.

(21) Appl. No.: 10/682,615

(22) Filed: Oct. 9, 2003

(51) Int. Cl.
*B65D 50/04* (2006.01)
*B65D 53/02* (2006.01)

(52) U.S. Cl. ..... 215/222; 215/332; 215/344; 215/DIG. 1

(58) Field of Classification Search ..... 215/219, 215/331, 342, 344, DIG. 1, 44, 45, 222, 332, 215/343
See application file for complete search history.

(56) References Cited

U.S. PATENT DOCUMENTS

| | | | | | |
|---|---|---|---|---|---|
| 3,053,406 | A | | 9/1962 | Wandell | |
| 3,255,907 | A | * | 6/1966 | Eddy | 215/329 |
| 3,286,866 | A | | 11/1966 | McIntosh | |
| 3,393,818 | A | * | 7/1968 | McIntosh | 215/260 |
| 3,435,978 | A | * | 4/1969 | Wittwer | 215/217 |
| 3,814,274 | A | * | 6/1974 | McIntosh | 215/344 |
| 3,815,771 | A | | 6/1974 | Marks | |
| 3,844,439 | A | * | 10/1974 | Demers et al. | 215/344 |
| 3,888,373 | A | * | 6/1975 | Gach et al. | 215/214 |
| 3,917,096 | A | | 11/1975 | Hedgewick | |
| 3,944,104 | A | * | 3/1976 | Watson et al. | 215/307 |
| 4,069,937 | A | * | 1/1978 | Smalley | 215/344 |
| 4,084,716 | A | | 4/1978 | Bogert | |
| 4,089,463 | A | * | 5/1978 | Babiol | 215/329 |
| 4,139,112 | A | | 2/1979 | Cooke | |
| 4,320,844 | A | | 3/1982 | Cooper | |
| 4,360,114 | A | * | 11/1982 | Owens | 215/329 |
| 4,429,802 | A | * | 2/1984 | Marks | 215/344 |
| 4,531,649 | A | * | 7/1985 | Shull | 215/232 |
| 4,579,238 | A | * | 4/1986 | Herr | 215/211 |
| 4,667,839 | A | * | 5/1987 | Crisci | 215/256 |
| 4,955,504 | A | * | 9/1990 | Lesscher | 220/321 |
| 5,169,033 | A | | 12/1992 | Shay | |
| 5,320,236 | A | * | 6/1994 | Gregory | 215/344 |
| 5,803,287 | A | * | 9/1998 | Kusz | 215/330 |
| 6,044,994 | A | | 4/2000 | Miller | |
| 6,848,590 | B1 | * | 2/2005 | Brozell et al. | 215/220 |

FOREIGN PATENT DOCUMENTS

| | | | |
|---|---|---|---|
| DE | 2625875 | | 12/1977 |
| GB | 960443 | | 6/1964 |
| JP | 10203551 | A * | 8/1998 |

* cited by examiner

*Primary Examiner*—Nathan J. Newhouse
*Assistant Examiner*—James Smalley

(57) ABSTRACT

A child resistant package includes a container having a finish with at least one external thread and at least one pocket in an undersurface of the thread. A closure for receipt on the finish of the container has a base wall, a skirt with an axis, at least one internal thread having at least one lug for receipt in the pocket of the container finish, and a spring disposed between the base wall and the container finish external thread. The spring yieldably biases the closure away from the finish and urges the lug into the pocket. The spring is a progressive spring that includes at least two spring rings preferably extending from the base wall at an angle to the axis of the skirt. The spring rings are radially spaced from each other and a first spring ring has a greater axial dimension or length than a second spring ring, with the first spring ring axially overlying the second spring ring.

2 Claims, 2 Drawing Sheets

CHILD-RESISTANT PACKAGE

FIELD OF THE INVENTION

This invention relates generally to a closure and container package, and more particularly to a child-resistant package.

BACKGROUND OF THE INVENTION

Various closure and container packages that resist opening by a child have been proposed in the art. Such packages are commonly used to store products such as medicine and various toxic or caustic products. To resist opening of the package by a child, the containers typically have closures which require multiple coordinated actions to open the closure and dispense product (for example, requiring a lid to be pushed down and simultaneously turned).

SUMMARY OF THE INVENTION

A child resistant package includes a container having a finish with at least one external thread and at least one pocket in an undersurface of the thread. A closure for receipt on the finish of the container has a base wall, a skirt with an axis, at least one internal thread having at least one lug for receipt in the pocket of the container finish external thread, and a spring disposed between the base wall and the container finish. The spring yieldably biases the closure away from the finish and urges the lug into the pocket. The spring is a progressive spring that includes at least two spring rings preferably extending from the base wall at an angle to the axis of the skirt. The spring rings are radially spaced from each other and a first spring ring has a greater axial dimension or length than a second spring ring, with the first spring ring axially overlying the second spring ring.

In one presently preferred embodiment of the closure and container package, three preferably circumferentially continuous and concentric spring rings are provided on the closure. At least one of the spring rings may directly engage the end of the container finish to cause compression or deformation of the spring ring when the closure is secured to the finish. The spring biases the closure in a direction moving the base wall of the closure away from the finish. This urges the lug into the pocket to prevent rotation of the closure without first axially displacing the closure to move the lug out of the pocket. In this manner, both axial and rotational manipulation is required to remove the closure from the container. The above description is illustrative of one presently preferred embodiment, and is not intended to be limiting of the invention. Modifications or substitutions will be apparent to those of ordinary skill in the art from this disclosure and appended claims.

BRIEF DESCRIPTION OF THE DRAWINGS

These and other objects, features and advantages of the present invention will be apparent from the following detailed description of the preferred embodiments, appended claims and accompanying drawings in which:

DETAILED DESCRIPTION OF THE PREFERRED EMBODIMENTS

Figure 1:
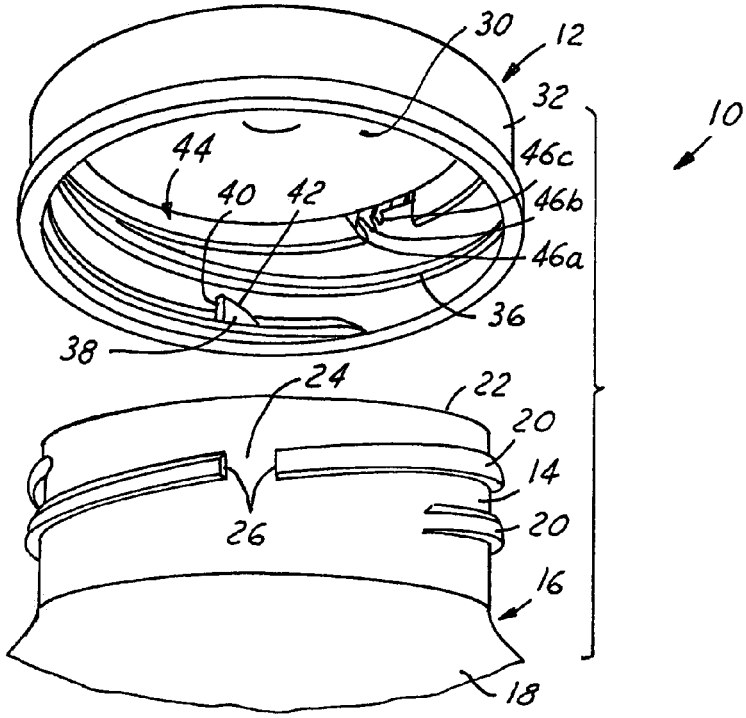
FIG. 1 is a fragmentary perspective view of one presently preferred embodiment of a child resistant closure and container package.
Figure 2:
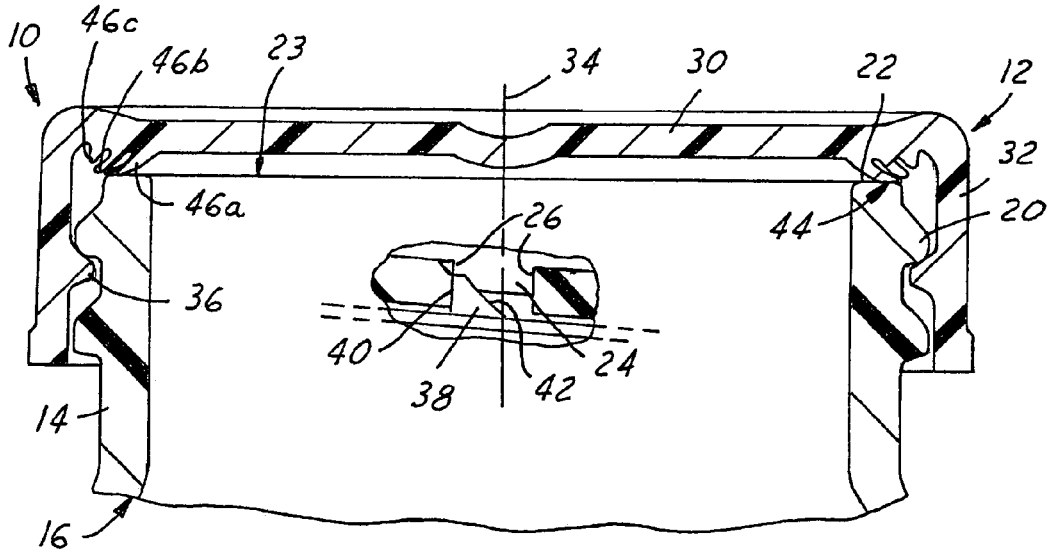
FIG. 2 is a fragmentary sectional view with a portion broken away and in section of the package illustrated in FIG. 1.
Figure 3:
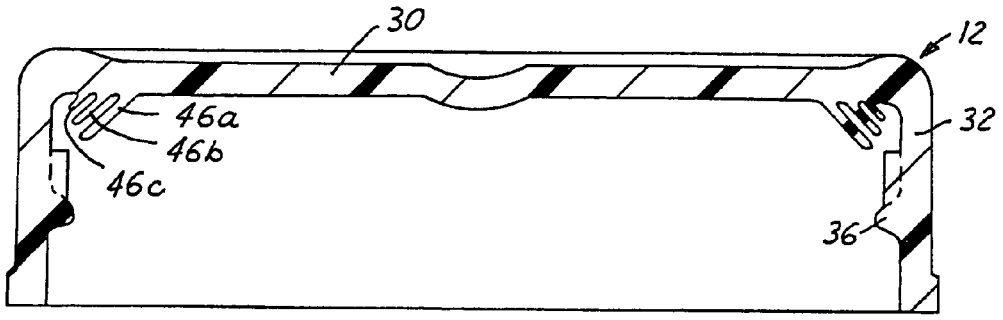
FIG. 3 is a sectional view of the closure of the package illustrated in FIG. 1.

Referring in more detail to the drawings, FIGS. 1–3 illustrate a first presently preferred embodiment of a child resistant closure and container package 10. The package 10 includes a closure 12 constructed for receipt on a finish 14 of the container 16. The closure 12 and container 16 have various features which require that the closure 12 be pressed axially toward the container 16 before it can be rotated relative to and removed from the container 16.

The container 16 has a main body 18 defining an interior volume in which a product may be stored. The container body 18 terminates at the finish 14 which has at least one external thread 20 and an axially facing end 22 surrounding a container mouth 23. At least one pocket 24 is formed in an undersurface of the external thread 20 on the container finish 14. Preferably, more than one pocket 24 may be formed on or in the thread 20, and as shown in FIG. 1, the pocket 24 may defined by an interruption in the thread 20. The interruption, or pocket 24 in the thread 20, provides generally radially outwardly extending shoulders 26 with a gap between them.

The closure 12 has a base wall 30 of a size sufficient to overlie the axially facing end 22 of the container finish 14. A peripheral skirt 32 extends from the base wall 30 and preferably is generally cylindrical and has a longitudinal axis 34. At least one internal thread 36 is formed on the skirt 32 for threaded receipt on the container finish 14. At least one lug 38 is formed on or adjacent to the internal thread 36. The lug 38 is sized and arranged for receipt in the pocket 24 on the container finish 14 when the closure 12 is secured onto the container 16. Preferably, the lug 38 has a generally axially extending shoulder 40 constructed to engage one of the radially outwardly extending shoulders 26 on the container finish 14 to prevent rotation of the closure 12 in a direction tending to remove the closure 12 from the container 16 when the lug 38 is received in the pocket 24. The lug 38 may also have a ramp surface 42 so that the lug 38 is generally triangular in shape, to facilitate rotation of the closure 12 relative to the container 16 when the lug 38 is not disposed in the pocket 24. Preferably, more than one lug 38 are provided with the lugs 38 circumferentially spaced apart on the closure 12, and each lug 38 preferably is adapted to be received in a corresponding pocket 24 on the container finish 14. For example, without limitation, two pockets 24 may be provided generally 180 degrees apart, and two lugs 38 may be provided on the closure 12 also generally 180 degrees apart so that when the closure 12 is secured on the container 16 each pocket 24 receives a separate one of the lugs 38.

A spring 44 is disposed between the base wall 30 of the closure 12 and the end 22 of the container finish 14. The spring 44 biases the closure 12 in a direction moving the base wall 30 away from the finish 14 and urges at least one lug 38 into its corresponding pocket 24 as will be discussed in more detail below. The spring 44 preferably is a progressive spring including at least two circular spring rings 46. The spring rings 46 preferably are circumferentially continuous, radially spaced from each other, and preferably extend from the base wall 30 at an angle to the axis 34 of the closure skirt 32. As shown in FIGS. 1–3, three circumferentially continuous and preferably concentric spring rings 46*a*–*c* are integral with and extend axially downwardly and radially outwardly from the base wall 30 of the closure 12 so that the rings 46*a*–*c* are inclined relative to the axis of the closure skirt 32. A first spring ring 46*a* has a greater axial length or dimension than a second spring ring 46*b* disposed radially outwardly from the first spring ring 46*a*. Preferably, the first spring ring 46*a* axially overlies the second spring ring 46*b*. The first spring ring 46*a* preferably also radially overlies at least a portion of the second spring ring 46*b*. In the embodiment shown, a third spring ring 46*c* is disposed radially outwardly of the second spring ring 46*b*, and preferably has a shorter axial dimension than the second spring ring 46*b*. The second spring ring 46*b* preferably axially and radially overlies the third spring ring 46*c*.

As shown in FIG. 2, when the closure 12 is secured onto the container finish 14, at least the first spring ring 46*a* engages the axially facing end 22 of the container finish 14 and is deformed by such engagement. Preferably, the first spring ring 46*a* provides a seal between the container 16 and the closure 12. When deformed, the first spring ring 46*a* may engage the second spring ring 46*b* to deform it, or the second spring ring 46*b* may engage the container finish 14 causing it to be deformed. Deformation of the first and/or second spring rings 46*a*, 46*b* provides a spring force tending to push the base wall 30 of the closure 12 away from the container finish 14.

As shown in FIG. 2, when the closure is on the container, the lug 38 on the closure 12 is urged and positioned in the pocket 24 on the container finish 14. In this position, rotation of the closure 12 is prevented by engagement of the lug 38 with one of the shoulders 26 on the container finish 14, to prevent removal of the closure 12 from the container 16 by simple rotation of the closure 12. Rather, to remove the closure 12 from the container 16, the closure 12 must be pressed axially so that the base wall 30 moves towards the container finish 14, further deforming or deflecting the spring rings 46*a*–*c*. When the closure 12 has moved sufficiently relative to the container 16, each lug 38 is removed from its corresponding pocket 24 and thereafter the closure 12 may be rotated to remove it from the container 16. The axial movement of the closure 12 toward the container 16 preferably causes the second spring ring 46*b* to engage the third spring ring 46*c* adding additional spring force resisting the axial movement of the base wall 30 toward the container finish 14.

Preferably, the spring rings 46*a*–*c* are not only of different sizes, but may also have different spring characteristics. As shown, the first spring ring 46*a* may be the thickest and stiffest, while the third spring 46*c* is the thinnest and smallest. The spring rings 46*a*–*c* are positioned to be engaged by the end 22 of the container 16 or by an adjacent ring, and sequentially collapsed onto each other as the closure 12 is threaded onto and axially moved on the container 16.

Figure 4:
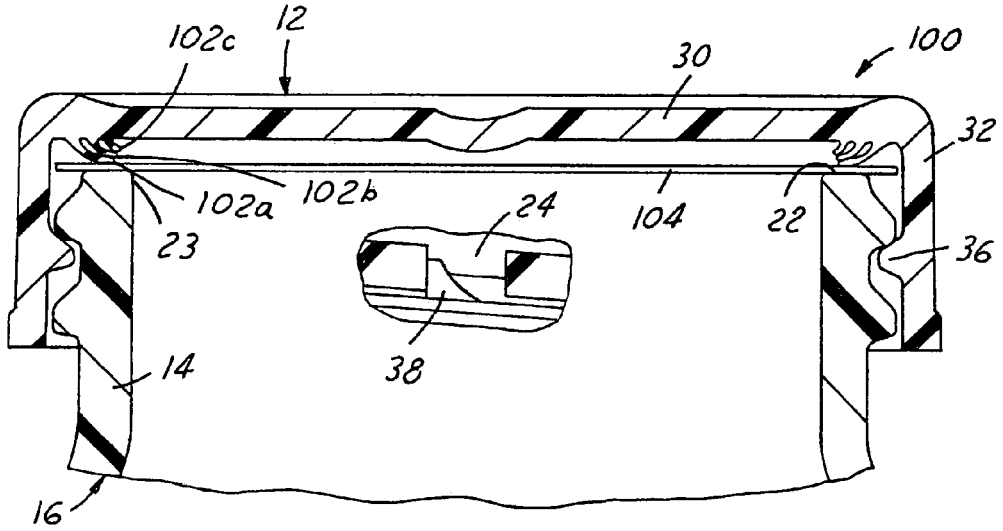
FIG. 4 is a fragmentary sectional view of a second presently preferred embodiment of a closure and container package.
Figure 5:
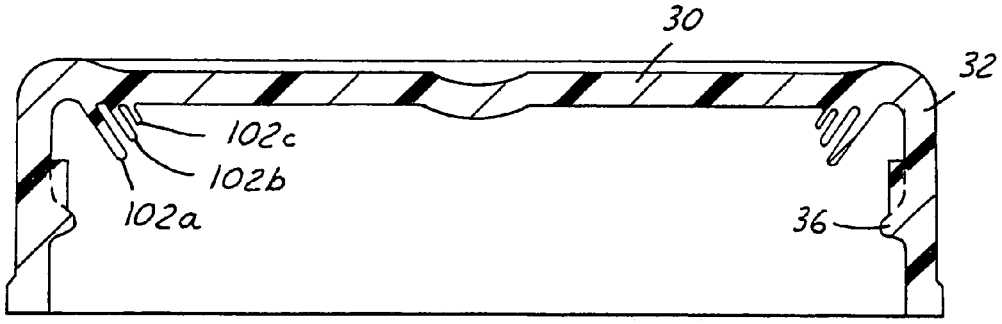
FIG. 5 is a sectional view of the closure of the package illustrated in FIG. 4.

A second presently preferred embodiment of a closure and container package 100 is shown in FIGS. 4 and 5. As shown, this package 100 may be constructed in a substantially identical manner to the first described package 10 with the exception that the orientation and arrangement of the spring rings 102*a*–*c* is different. Hence, the remainder of the closure and container package 100 will not be described again.

In this embodiment package 100, at least two, and preferably three spring rings 102*a*–*c* are provided extending axially and radially inwardly from the base wall 30 of the closure 12. The spring rings 102*a*–*c* preferably function generally in the same manner as in the first embodiment package 10, and may engage the container finish 14 to provide the force biasing the base wall 30 away from the container finish 14. In FIG. 4, a seal 104 is shown on the end 22 of the finish, covering the container mouth 23. This seal 104 is typically removed upon first use of the container.

When deflected or deformed, the first spring ring 102*a* preferably collapses onto the second spring ring 102*b* which may likewise collapse onto the third spring ring 102*c*. This deformation or collapsing occurs generally radially inwardly with the second spring ring 102*b* disposed radially inwardly of the first spring ring 102*a* and the third spring ring 102*c* disposed radially inwardly of the second spring ring 102*b*. The spring rings 102*a*–*c* urge the closure 12 upwardly with respect to the finish 14 so that the lugs 38 "snap" or otherwise are received into the pockets 24 on the container finish 14. In this position the lugs 38 prevent removal of the closure 12 unless the closure 12 is simultaneously pushed downwardly on the container finish 14 so that the lugs 38 are sufficiently removed from their corresponding pockets 24 and the closure 12 can be rotated on the finish 14. The spring rings 102*a*–*c* can be of different sizes and have different spring characteristics as discussed above.

Persons of ordinary skill in the art will recognize that the above description is intended to be illustrative of a couple presently preferred embodiments of the present invention, and not limiting thereof. Modifications and substitutions may be made without departing from the spirit and broad scope of the present invention as set forth in the appended claims. For example, without limitation, the spring rings have been shown and described as three concentric rings extending from the base wall, but more or less than three rings may be used, and the spring rings may be otherwise carried by the closure so that the spring is disposed between the closure and the container. Further, also without limitation, the spring rings may be the same size, or may have different sizes, thicknesses or stiffness characteristics then as specifically described in the disclosed embodiments. Likewise, the spring rings may or may not be circumferentially continuous. Other modifications and variations will be apparent to skilled artisans in view of this disclosure, including the claims that follow.

The invention claimed is:

1. A child-resistant closure and container package that includes:

a container having a finish with at least one external thread, at least one pocket in an undersurface of said external thread, and an axially facing end surface surrounding a container mouth, and a closure having a base wall, a skirt with an axis, at least one internal thread and at least one lug on said internal thread for receipt in said pocket, and a spring disposed between said base wall and said end surface of said finish to bias said closure away from said finish and urge said lug into said pocket, said spring comprising a progressive spring that includes at least two circumferentially continuous concentric flexible resilient conical spring rings extending from said base wall at identical angles to said axis, said spring rings being radially spaced from each other, and a first of said spring rings having a greater axial dimension than a second of said spring rings and axially and radially overlapping said second spring ring, such that, upon threaded application of said closure to said finish, said first spring ring is engaged by said end surface and, upon further application of said closure to said finish, said first spring ring is bent into engagement with said second spring ring such that forces applied by said first spring ring to said end surface, both to seal said package and to bias said closure away from said finish, is a progressive sum of forces generated in said first and second spring rings, said first spring ring but not said second spring ring contacting said end surface, wherein said spring rings are of differing thicknesses, said first spring ring being thinner than said second spring ring, and wherein said progressive spring includes a third conical circumferentially continuous flexible resilient spring ring concentric with said first and second spring rings and extending from said base wall at an angle to said axis identical to that of said first and second spring rings, said third spring ring being disposed adjacent to said second spring ring and remote from said first spring ring, said third spring ring being of lesser axial dimension than said second spring ring, said second spring ring axially and radially overlapping said third spring ring such that, upon continued threaded application of said closure to said finish, forces applied to said second spring ring by said first spring ring bend said second spring ring into engagement with said third spring ring and said spring forces applied by said first spring ring to said end surface are progressive sum of forces generated in said first, second and third spring rings, said first spring ring but not said second spring ring or said third spring ring contacting said end surface.

2. A closure for application to a container neck finish having an end surface, which includes:

a base wall, a skirt with an axis, at least one internal thread for receipt on the container neck finish, and a spring to bias said closure away from the finish, said spring comprising a progressive spring that includes at least two circumferentially continuous concentric flexible resilient conical spring rings extending from said base wall at identical angles to said axis, said spring rings being radially spaced from each other, and a first of said spring rings having a greater axial dimension than a second of said spring rings and axially and radially overlapping said second spring ring, such that, upon threaded application of said closure to a container finish, said first spring ring is positioned to be engaged by an end surface of the container finish and, upon further application of said closure to the finish, said first spring ring is bent into engagement with said second spring ring such that forces applied by said first spring ring to the finish end surface, both to seal the container and to bias said closure away from the container finish, is a progressive sum of forces generated in said first and second spring rings, said first spring ring but not said second spring ring being disposed to contact the end surface of the container finish, wherein said spring rings are of differing thicknesses, said first spring ring being thinner than said second spring ring, and wherein said progressive ring includes a third conical circumferentially continuous flexible resilient spring ring concentric with said first and second spring rings and extending from said base wall at an angle to said axis identical to that of said first and second spring rings, said third spring ring being disposed adjacent to said second spring ring and remote from said first spring ring, said third spring ring being of lesser axial dimension than said second spring ring, said second spring ring axially and radially overlapping said third spring ring such that, upon continued threaded application of said closure to the container finish, forces applied to said second spring ring by said first spring ring bend said second spring ring into engagement with said third spring ring and said spring forces applied by said first spring ring to the finish end surface are a progressive sum of forces generated in said first, second and third spring rings, said first spring ring but not said second spring ring or said third spring ring being disposed to contact the finish end surface.

* * * * *